US011851800B2

(12) United States Patent
Boerner et al.

(10) Patent No.: US 11,851,800 B2
(45) Date of Patent: Dec. 26, 2023

(54) FLUID-CONDUCTING DOMESTIC APPLIANCE

(71) Applicant: BSH Hausgeraete GmbH, Munich (DE)

(72) Inventors: Oliver Boerner, Berlin (DE); Ulas Demirkaya, Potsdam (DE); Sebastian Schmidt, Berlin (DE)

(73) Assignee: BSH Hausgeraete GmbH, Munich (DE)

( * ) Notice: Subject to any disclaimer, the term of this patent is extended or adjusted under 35 U.S.C. 154(b) by 99 days.

(21) Appl. No.: 17/621,814

(22) PCT Filed: Jun. 25, 2020

(86) PCT No.: PCT/EP2020/067799
§ 371 (c)(1),
(2) Date: Dec. 22, 2021

(87) PCT Pub. No.: WO2020/260446
PCT Pub. Date: Dec. 30, 2020

(65) Prior Publication Data

US 2022/0243380 A1 Aug. 4, 2022

(30) Foreign Application Priority Data

Jun. 27, 2019 (DE) ..... 102019209364.7

(51) Int. Cl.
*D06F 34/34* (2020.01)
*D06F 34/32* (2020.01)
(Continued)

(52) U.S. Cl.
CPC ..... *D06F 34/34* (2020.02); *D06F 34/32* (2020.02); *D06F 39/14* (2013.01); *D06F 2105/58* (2020.02)

(58) Field of Classification Search
CPC ..... D06F 34/34; D06F 34/32; D06F 39/14; D06F 2105/58
(Continued)

(56) References Cited

U.S. PATENT DOCUMENTS

2012/0327201 A1 12/2012 Kappler et al.

FOREIGN PATENT DOCUMENTS

CN 106544816 A 3/2017
CN 208562869 U 3/2019
(Continued)

OTHER PUBLICATIONS

CN208562869U—machine translation (Year: 2019).*

*Primary Examiner* — Tinsae B Ayalew
(74) *Attorney, Agent, or Firm* — Laurence A. Greenberg; Werner H. Stemer; Ralph E. Locher

(57) ABSTRACT

A fluid-conducting domestic appliance has a housing with a receiving container, an opening, and a door unit which has a transparent viewing window and a window element. The window element is formed opposite the viewing window and at least partly protrudes into the receiving container when the door unit is closed such that the receiving container can be viewed when the opening is closed. An electronic unit is provided and has a projection unit that is provided in the region of the viewing window. An optical unit is provided which contains at least one reflection element and is arranged in an upper region of the door unit such that emitted light is reflected by the reflection element onto the projection surface in the region of the viewing window.

11 Claims, 8 Drawing Sheets

(51) Int. Cl.
*D06F 39/14* (2006.01)
*D06F 105/58* (2020.01)

(58) Field of Classification Search
USPC ..... 68/3 R
See application file for complete search history.

(56) References Cited

FOREIGN PATENT DOCUMENTS

| | | | |
|---|---|---|---|
| DE | 102012103684 | A1 | 10/2013 |
| DE | 102015220427 | A1 | 4/2017 |
| EP | 3115497 | A1 | 1/2017 |
| WO | 2018086872 | A1 | 5/2018 |

* cited by examiner

FLUID-CONDUCTING DOMESTIC APPLIANCE

FIELD AND BACKGROUND OF THE INVENTION

The invention relates to a fluid-conducting household appliance as claimed in the independent fluid-conducting household appliance claim and a door unit as claimed in the independent door unit claim.

DE 10 2012 103 684 A1 discloses a household appliance with a housing having a projector. The projector is arranged in the housing and projects a projection image onto an outer surface of the housing. Herein, in particular two optics are assigned to the projector which deflect a light beam outgoing from the projector such that the light beam is guided into an inner space of a door element of the household appliance. Herein, a projection image is projected on an inner surface of a viewing pane of the door element.

US 2012/0327201 A1 discloses a further top loading washing machine. The washing machine comprises a cover element, wherein the cover element has a display unit. A UV projection unit is arranged in a spoiler-like element embodied in a rear region of the cover element of the washing machine above the cover element and projects an image onto the cover element.

SUMMARY OF THE INVENTION

It is therefore an object of the invention to create a fluid-conducting household appliance that depicts visual information in a door unit of a fluid-conducting household appliance and provides a user with the familiar surface of a fluid-conducting household appliance.

The object of the invention is achieved by the features of the independent claims. Further advantageous embodiments of the invention are disclosed in the subclaims and in the description and the drawings.

According to one aspect of the invention, the object according to the invention is achieved by a fluid-conducting household appliance. The fluid-conducting household appliance comprises a housing with a receiving container and an opening. The fluid-conducting household appliance further comprises a door unit, wherein the door unit is provided to close the opening, wherein the door unit comprises a viewing window and a window element. The window element is embodied opposite the viewing window and at least partially protrudes into the receiving container when the door unit is closed. The viewing window is substantially transparent so that the receiving container can be viewed when the opening is closed. Furthermore, the fluid-conducting household appliance comprises an electronic unit comprising at least one projection unit, wherein the at least one projection unit emits light such that visual information is visible on a projection surface, wherein the projection surface is provided in the region of the viewing window. Furthermore, an optical unit is provided, wherein the optical unit comprises at least one reflection element, wherein the optical unit is arranged in an upper region of the door unit such that the light emitted by the projection unit is reflected or can be reflected by the reflection element of the optical unit onto the projection surface in the region of the viewing window.

It should be mentioned that the emitted light can also be referred to as at least one light beam and/or at least one projection beam. The projection unit emits enough light or enough light beams and/or projection beams to enable visual information to be made visible in words and/or writing as well as in the form of an image and/or symbols. Further options for depicting the visual information are conceivable.

Since the optical unit is arranged in an upper region of the door unit, a user is still able to look into the receiving container when the opening is closed, wherein visual information can be depicted on a desired projection surface. Thus, the user does not experience any restriction with regard to the visibility of the receiving container.

The door unit advantageously comprises at least one frame element, wherein the reflection element is arranged in an upper region of the door unit in the region of the at least one frame element, wherein the at least one frame element is arranged substantially closer to the receiving container than the viewing window when the door unit is closed. This configuration ensures that the user is able to look into the fluid-conducting household appliance at any time.

The reflection element preferably has mirror-like properties and is embodied as substantially non-transparent. The reflection element can be a mirror element or an element coated with a reflectable surface, such as, for example, a foil or the like.

The mirror-like properties of the reflection element are particularly suitable for deflecting the light emitted by the projection unit to enable visual information to be visualized or displayed on the projection surface.

In one preferred embodiment, the optical unit is connected to the at least one frame element, as a result of which the optical unit can be easily received or integrated in the door unit.

Alternatively, it is also conceivable that the optical unit can be connected to the at least one frame element. The optical unit can be connected to the at least one frame element in any desired manner. This enables, for example, easy replacement of the optical unit if it should be damaged. This means that the optical unit is a separate component and can be connected to the at least one frame element.

It is conceivable that the optical unit can be welded and/or screwed with the at least one frame element and/or can be snapped into the least one frame element or latched with the at least one frame element. The optical unit comprises the reflection element, wherein the reflection element can be attached directly to the at least one frame element. The reflection element can also be welded to or welded on the at least one frame element and/or bolted or screwed and/or latched to the at least one frame element.

Advantageously, the optical unit comprises a holding apparatus, wherein the reflection element is arranged on the holding apparatus. As a result, the reflection element is arranged firmly and stably in the optical unit such that the reflection element withstands impacts that can occur when the door unit is closed.

The holding apparatus of the optical unit is preferably embodied in one piece with the at least one frame element. The optical unit can be delivered and/or integrated as a prefabricated component into the production of the door unit or of the fluid-conducting household appliance, as a result of which there are fewer production steps on a production line and potential assembly errors are minimized.

The holding apparatus advantageously has a rear side arranged in the direction of the window element, wherein the rear side has at least one first region comprising at least one first rib.

The at least one first rib is used to reinforce the holding apparatus such that the holding apparatus component is strengthened. The more first ribs are embodied, the greater the reinforcement of the holding apparatus. The number of first ribs depends on the size of the holding apparatus and the desired degree of reinforcement of the holding apparatus.

Advantageously, the holding apparatus has an anterior side, which is embodied opposite the rear side such that the anterior side is at least partially spaced further apart from the window element than the rear side of the holding apparatus, wherein the anterior side has at least one second region comprising at least one second rib.

Similarly to the at least one first rib, the at least one second rib is used to reinforce the holding apparatus component. Furthermore, reducing the size of ribs enables material to be saved and manufacturing of components to be shortened, since, for example, cooling of a component, for example a component made of plastic, can be reduced. Therefore, it is not necessary to fill a region of the holding apparatus with, for example, plastic, which results in long cooling times. This can also shorten production times. The reflection element is preferably arranged on the anterior side of the holding apparatus, wherein the at least one second rib has an elevation.

The elevation is provided in order to slightly bend or curve the reflection element. As a result, the reflection element is placed under tension such that the reflection element can be arranged in a stable and vibration-resistant manner on the holding apparatus and, when the door unit is opened or the fluid-conducting household appliance is operated, it can be ensured that the visual information displayed on the projection surface is clearly legible for the user at all times.

Advantageously, the reflection element can be attached to the holding apparatus by at least one fastening means such that the at least one second rib is at least partially covered.

For optical reasons, it is advantageous that, when observing the fluid-conducting household appliance or the door unit more closely, a user only sees the reflection element and not the at least one rib embodied therebelow.

The reflection element preferably has at least one first projecting part and the holding apparatus has at least one first receiving opening such that the at least one first projecting part of the reflection element can be inserted into the at least one first receiving opening, wherein the holding apparatus has at least one second projecting part that holds the reflection element in position.

The at least one receiving opening of the holding apparatus is compatible with the at least one projecting part of the reflection element. The reflection element is thus easy to attach to the holding apparatus and it is also possible for incorrect assembly to be minimized. The at least one second projecting part of the holding apparatus can be embodied as a latching element. The reflection element is received or fastened in a latched manner on the holding apparatus by means of the at least one second projecting part.

In an alternative embodiment, the optical unit is arranged on the window element. As a result, the holding apparatus is saved, thus reducing or saving production costs.

According to a second aspect of the invention, the object according to the invention is achieved by a door unit of a fluid-conducting household appliance. The fluid-conducting household appliance comprises an optical unit according to one of the aforementioned aspects.

Further properties and advantages of the present invention emerge from the following description with reference to the drawings.

DETAILED DESCRIPTION OF THE INVENTION

Figure 1:
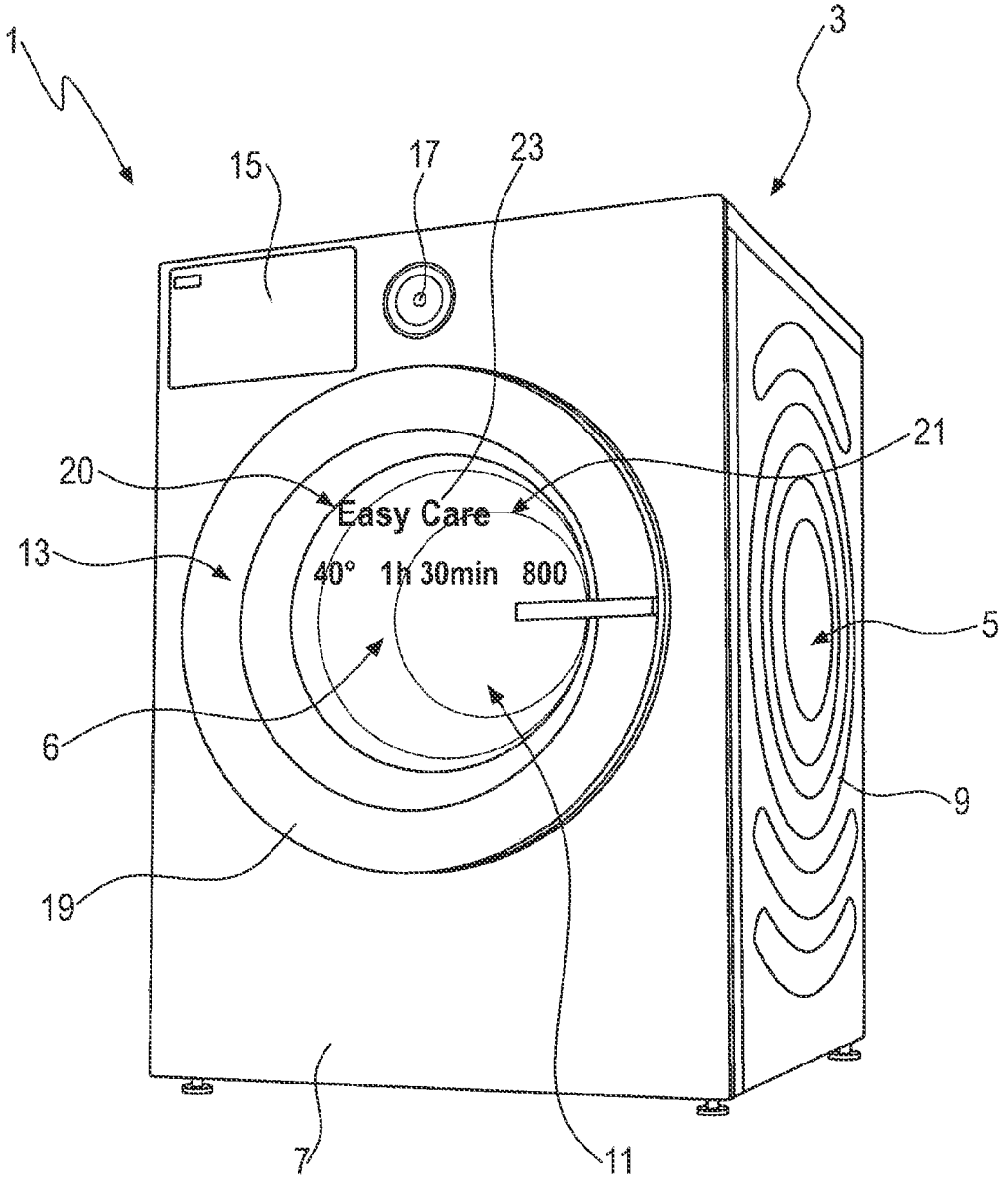
FIG. 1 shows a front view of a fluid-conducting household appliance.

FIG. 1 shows a front view of a household appliance 1. The household appliance shown in FIG. 1 can, for example, be a fluid-conducting household appliance 1, such as, for example, a washing machine, a washer dryer or a laundry dryer or a dishwasher, a fully automatic coffee machine and/or a steam cooker and/or a similar fluid-conducting household appliance. In the following, the exemplary embodiments are substantially described with reference to the washing machine 3.

The fluid-conducting household appliance 1 or the washing machine 3 comprises a housing 5. A receiving container 6 is arranged in the housing 5, in which, in the present exemplary embodiment, items that are to be cleaned, for example laundry, are substantially received or cleaned. Furthermore, the housing 5 has a front side 7 and side walls 9. An opening 11 is embodied in the front side 7 of the housing 5. The opening 11 can be closed by a door unit 13. The door unit 13 is substantially fastened rotatably on the housing 5. Further, a dispensing drawer 15 is indicated in an upper region of the front side 7 of the washing machine 3. A switch 17 is arranged in an upper region of the front side 7 of the fluid-conducting household appliance 1 next to the dispensing drawer 15. The switch 17 can also be embodied as a type of push button or the like. The switch 17 is substantially used to switch the fluid-conducting household appliance 1 on or off or as a confirmation switch for confirming a program or a process.

Figure 2:
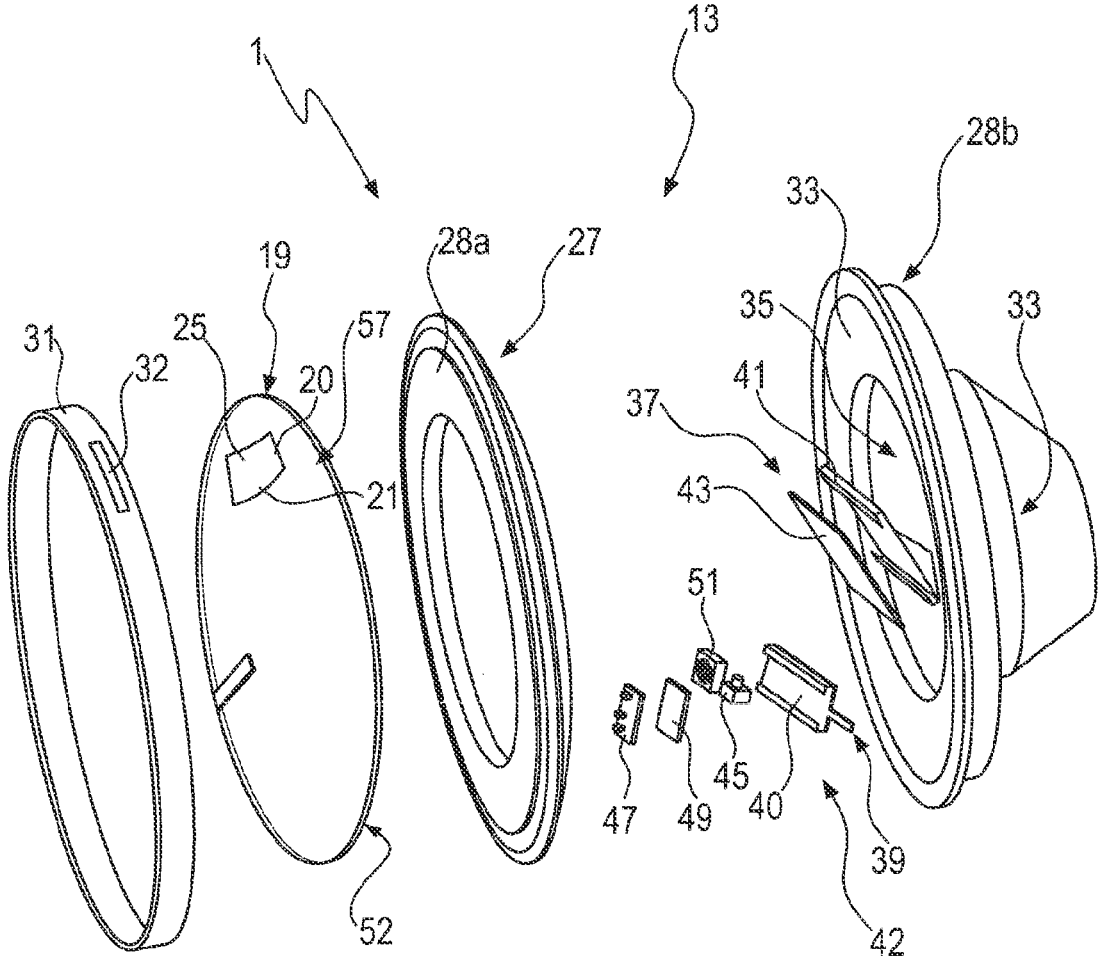
FIG. 2 shows an exploded view of a door unit of a fluid-conducting household appliance.

FIG. 2 is an exploded depiction of a door unit 13. The door unit 13 is in particular suitable for a fluid-conducting household appliance 1, in particular a washing machine 3. The door unit 13 has a viewing window 19, wherein the viewing window 19 can also be referred to as a viewing pane. The viewing window 19 is substantially transparent. A projection surface 20 is provided in the region of the viewing window 19. The projection surface 20 can extend over at least one partial region 21 of the viewing window 19. However, it is also conceivable that the projection surface 20 extends substantially over the entire viewing window 19 or at least over a large part of the viewing window 19. The projection surface 20 is used to display projection images 23. FIG. 1 shows a projection image 23 by way of example. In FIG. 1, the projection image 23 shows by way of example a washing program called 'Easy Care', wherein a washing temperature in degrees, the time to finish and the spin speed of the receiving container 6 are displayed. However, it is also conceivable that further information can be depicted. This can be depicted next to the aforementioned information and/or on a further display level that opens, for example, when an operating program has been selected.

The door unit 13 further comprises at least one frame element 27. In the exemplary embodiment shown in FIG. 2, the door unit 13 comprises a first frame element 28*a*, a second frame element 28*b*, a window ring 31, a window element 33 and the viewing window 19. The window element 33 is substantially arranged between the first frame element 28*a* and the second frame element 28*b*. The window element 33 is substantially received in the second frame element 28*b*. The viewing window 19 is arranged on the first frame element 28*a*. The window element 33 and the viewing window 19 are substantially arranged opposite one another, wherein the window element 33 protrudes into the housing 5, in particular into the receiving container 6 of the fluid-conducting household appliance 1, when the door unit 13 is closed. When the door unit 13 is closed, the viewing window 19 is substantially arranged outside the housing 5 of the fluid-conducting household appliance 1. A cavity 35 is embodied between the viewing window 19 and the window element 33. The viewing window 19 and the window element 33 are transparent. The viewing window 19 and the window element 33 can be made of glass and/or at least one polymer or the like. The viewing window can, for example, consist of at least one polymer, wherein the window element 33 is made of glass. Any embodiments are possible.

The cavity 35 is substantially formed by the viewing window 19, the first frame element 28*a*, the second frame element 28*b* and the window element 33. An optical unit 37 for guiding a light 38 (shown by way of example inter alia in FIG. 3) onto the projection surface 20 is substantially arranged in the cavity 35. An electronic unit 42 comprises a projection unit 39. The light 38 is generated by the projection unit 39 and can be emitted in the form of beams, in particular in the form of at least one light beam and/or projection beam. The projection unit 39 can, for example, be arranged in the door unit 13 with a holding unit 40. The projection unit 39 is preferably arranged in a lower region of the door unit 13. The projection unit 39 is preferably arranged on the at least one frame element 27, in particular on the first frame element 28. The projection unit 39 will be discussed in greater detail below.

The optical unit 37 comprises a reflection element 43. In the exemplary embodiment shown in FIG. 2, the optical unit 37 further comprises a holding apparatus 41. However, the reflection element 43 can also be arranged in the door unit 13 without a holding apparatus 41. This will be described in more detail below.

The optical unit 37 is arranged in the cavity 35 such that an operator or user can preferably look into the receiving container 6 of the fluid-conducting household appliance 1 when the door unit 13 is closed. The optical unit 37 is preferably arranged in an upper region of the door unit 13. The optical unit 37 is arranged substantially opposite the projection unit 39. The optical unit 37 and the projection unit 39 are substantially received in the cavity 35 of the door unit 13. Further, the projection surface 20 is substantially embodied in the cavity 35.

The projection unit 39 of the electronic unit 42 substantially comprises a projector 45 and a computer unit 47. The computer unit 47 is provided to actuate the projector 45. The computer unit 47 is provided to calculate the projection image 23 that is to be emitted by the projector 45. The projection unit 39 further comprises a control unit 49. The control unit 49 is provided to actuate the projector 45. The control unit 49 can, for example, be an LCoS control unit. The control unit 49 is provided to output a projection image 23 calculated by the computer unit 47 such that the projector 45 can depict the projection image 23 by irradiating the optical unit 37 or the projection surface 20. To prevent the projection unit 39 from overheating, a cooling unit 51 is embodied in the projection unit 39. The cooling unit 51 is provided to cool at least one further component of the projection unit 39, such as the projector 45, the computer unit 47 and/or the control unit 49.

The window ring 31 is substantially used to hold the door unit 13 together, wherein the window ring 31 is predominantly embodied to define the design. For example, a handle element 32 can be embodied on the window ring 31 if the handle element 32 is necessary or desirable. In addition, the window ring 31 is used to secure the at least one frame element 27 and the window element 33. In FIG. 2, the window ring 31 is embodied such that the window ring 31 is embodied or received comprising at least the first frame element 28*a* and the window element 33. The second frame element 28*b* can also be received in the window ring 33.

Figure 3:
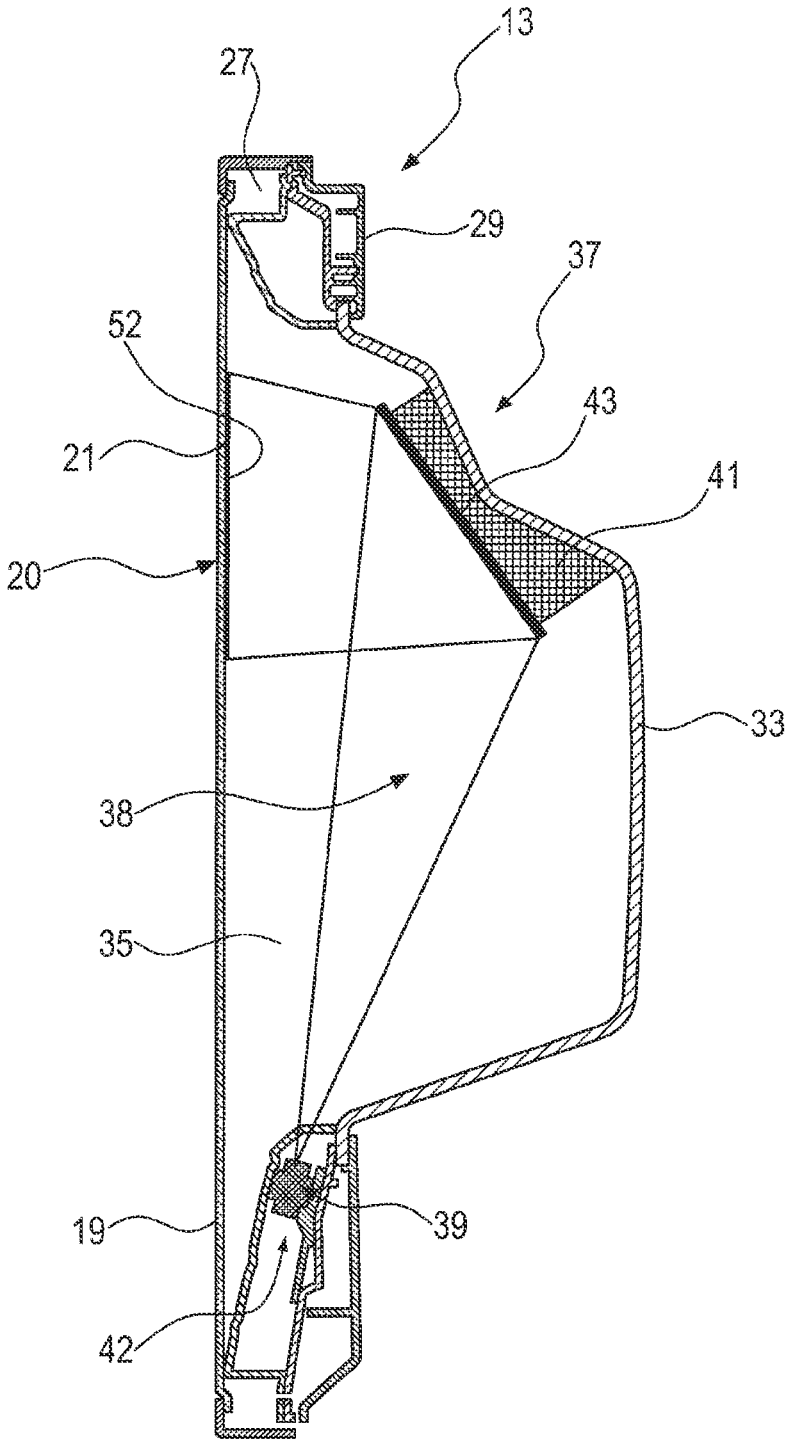
FIG. 3 shows a sectional depiction of an embodiment of a door unit of a fluid-conducting household appliance.

FIG. 3 is a sectional depiction of a possible embodiment of a door unit 13 of a fluid-conducting household appliance 1. Here, the optical unit 37, in particular the holding apparatus 41 of the optical unit 37, is attached by way of example in an upper region of the window element 33. Thus, an operator is further given the option of looking through the viewing window 19 and the window element 33 into the receiving container 6. However, it is also conceivable that the reflection element 43 is attached directly to the window element 33 and/or to the at least one frame element 27 of the door unit 13. The optical unit 37 can be arranged or fastened on the window element 33 and/or the at least one frame element 27 by means of various fastening and/or connecting methods or connecting techniques.

In FIG. 3, the optical unit 37 is by way of example arranged in an upper region of the window element 33 and oriented such that light 38 emitted by the projection unit 39 is guided and/or reflected onto the projection surface 20. By way of example, the projection surface 20 is arranged in an upper region of the viewing window 19. However, it is also conceivable that the projection surface 20 is substantially embodied on the entire viewing window 19. The projection image 23 is projected on an inner side 52 of the viewing window 19 that is directed toward the receiving container 6.

Figure 4A:
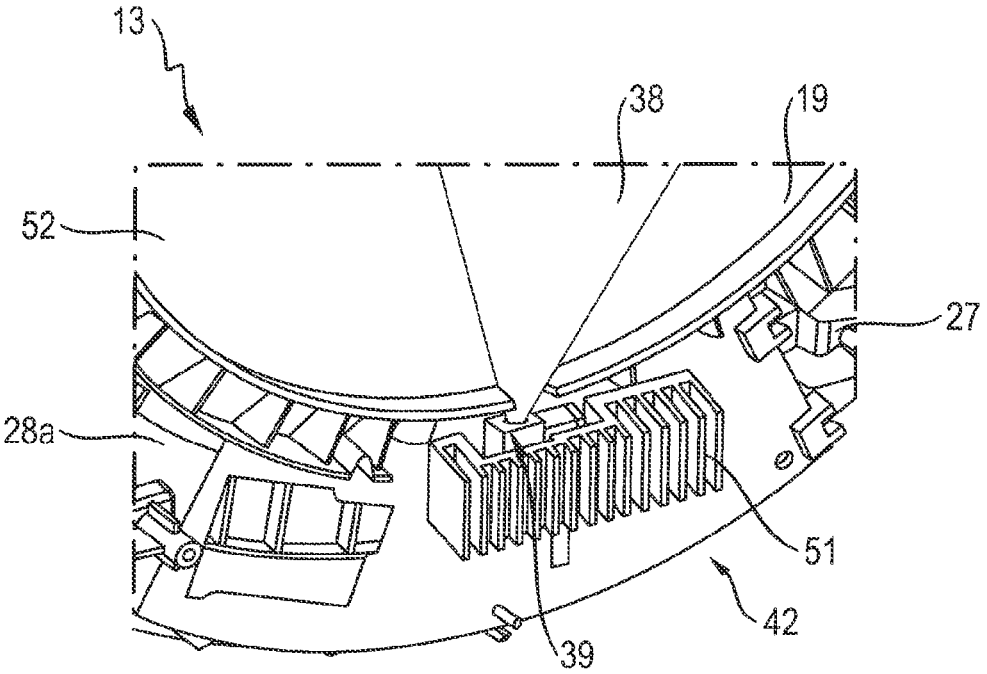
FIG. 4*a* shows a sectional depiction of an embodiment of a door unit of a fluid-conducting household appliance with an enlarged projection unit.
Figure 4B:
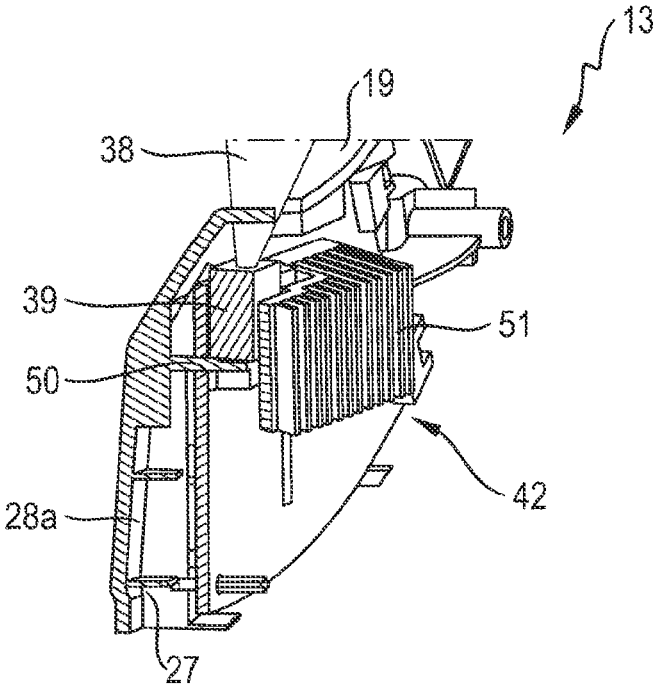
FIG. 4*b* shows a sectional view of an embodiment of a door unit of a fluid-conducting household appliance with an enlarged projection unit.

FIG. 4*a* and FIG. 4*b* show a sectional depiction of an embodiment of a door unit 13 of a fluid-conducting household appliance 1 with an enlarged projection unit 39. The projection unit 39 is preferably arranged between the first frame element 28*a* and the second frame element 28*b*. The projection unit 39 is preferably arranged in a lower region of the first frame element 28*a*. The projection unit 39 is preferably arranged in a lower region on the first frame element 28*a*. The projection unit 39 can be attached to the first frame element 28*a* with the holding unit 40. The projection unit 39 can be arranged on the first frame element 28*a* such that the projection unit 39 is arranged in the cavity 35 or at least protrudes into the cavity 35 and/or is arranged outside the cavity 35.

If the projection unit 39 is arranged outside the cavity 35, a frame opening 53 or a frame recess is provided in the first frame element 28*a* or in the at least one frame element 27. The frame opening 53 can ensure that the light 38 can be sent or projected by the projection unit 39 in the direction of the optical unit 37. The optical unit 37 is substantially arranged opposite the projection unit 39 such that, as mentioned above, light 38 that is generated and output by the projection unit 39 is guided onto the projection surface 20 via the optical unit 37. It should be mentioned once again that light 38 can also be referred to as light beams and/or projection beams. In FIGS. 4*a* and 4*b*, the above-described components of the projection unit 39 are also arranged in a lower region of the door unit 13 or of the at least one frame element 27.

In FIG. 4*b*, a positioning element 50 is embodied. The positioning element 50 is embodied in the region of the projection unit 39. The positioning element 50 is preferably embodied on the at least one frame element 27. The positioning element 50 can be embodied as a positioning pin. The positioning element 50 is provided to position the electronic unit 42 and/or the projection unit 39.

Figure 5:
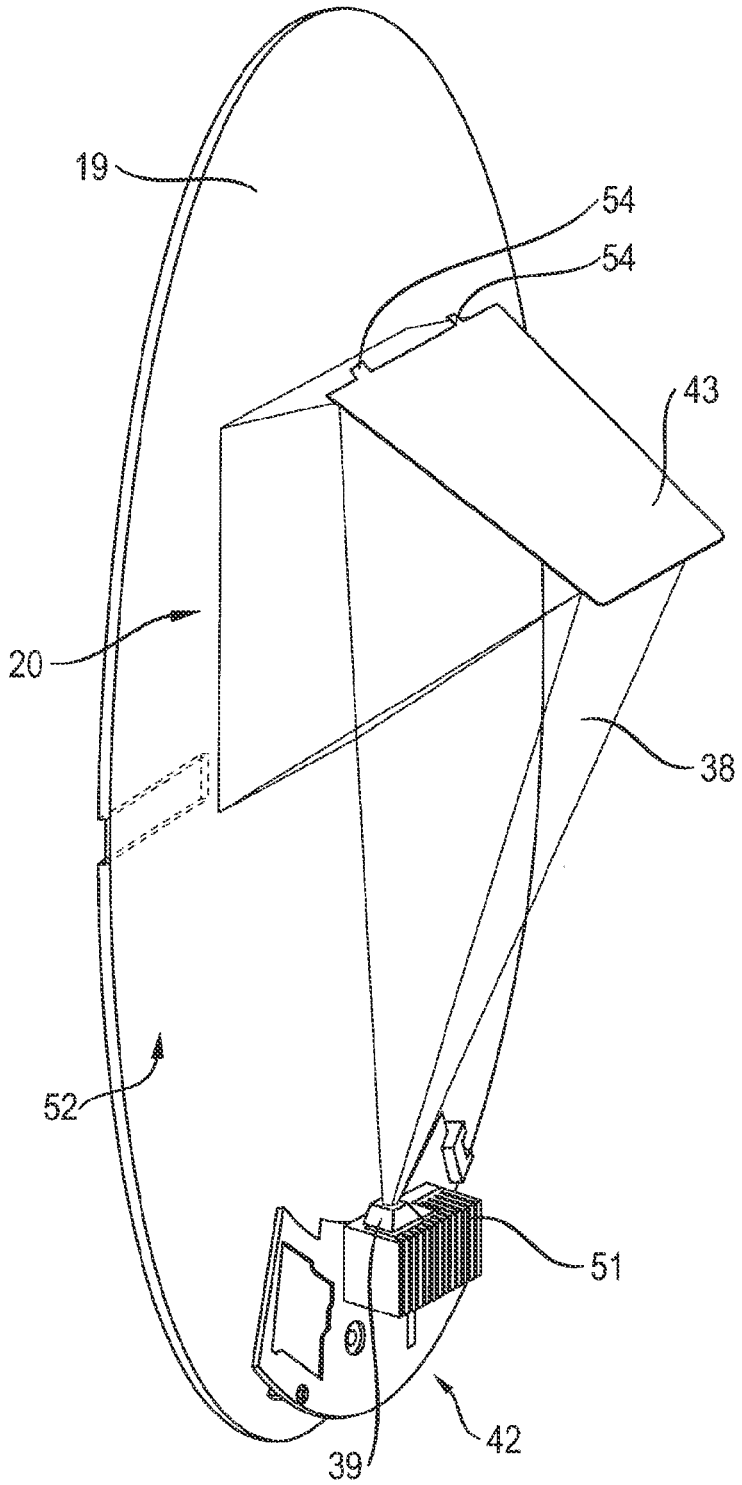
FIG. 5 shows a schematic depiction of light within a door unit of a fluid-conducting household appliance.

FIG. 5 is, by way of example, a schematic depiction of light 38, in the form of a visualized beam and/or a light cone, within the door unit 13 of a fluid-conducting household appliance 1. Some elements of the door unit 13, such as, for example, the viewing window 19, the projection unit 39, the reflection element 43 of the optical unit 37 and the light 38 emitted by the projection unit 39 are depicted here. The projection unit 39 emits light 38 in the direction of the reflection element 43. The reflection element 43 reflects the light 38 such that the light 38 is directed or reflected onto the inner side 52 of the viewing window 19.

Here, the inner side 52 in particular represents the projection surface 20, wherein information is displayed by way of example visually at or on the projection surface 20 or the inner side 52 of the viewing window 19, for example in the form of projection images 23.

Figure 6A:
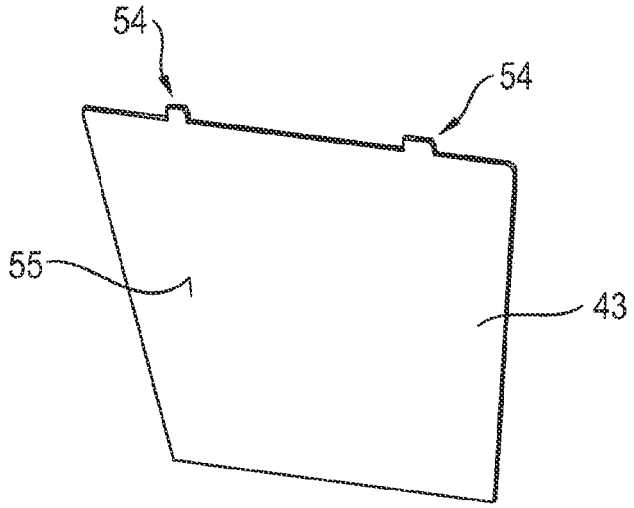
FIG. 6*a* shows an exemplary embodiment of a reflection element.

FIG. 6*a* depicts an exemplary embodiment of a reflection element 43. The reflection element 43 may have any shape. The reflection element 43 preferably has a substantially quadrangular shape. The reflection element 43 has at least one first projecting part 54 on one side. The reflection element 43 preferably has two first projecting parts 54. In order to minimize or exclude incorrect assembly, the two first projecting parts 54 are embodied differently. For example, one first projecting part 54 is larger than the other first projecting part 54. Further first projecting parts 54 are conceivable.

The reflection element 43 has at least one reflectively coated surface 55. Furthermore, the reflection element 43 is embodied as substantially non-transparent. The coated surface 55 can consist of a film and/or be a mirror-like element. The reflection element 43 should have at least one reflective property such that the light 38 is reflected.

For purposes of better illustration, the at least one frame element 27 is not depicted in FIG. 5. However, it is evident from the above-described embodiments that the electronic unit 42, in particular the projection unit 39, and the optical unit 37 are arranged on the at least one frame element 27 or connected to the at least one frame element 27. The electronic unit 42 and the optical unit 37 are preferably arranged on the first frame element 28*a* or connected to the first frame element 28*a*.

Figure 6B:
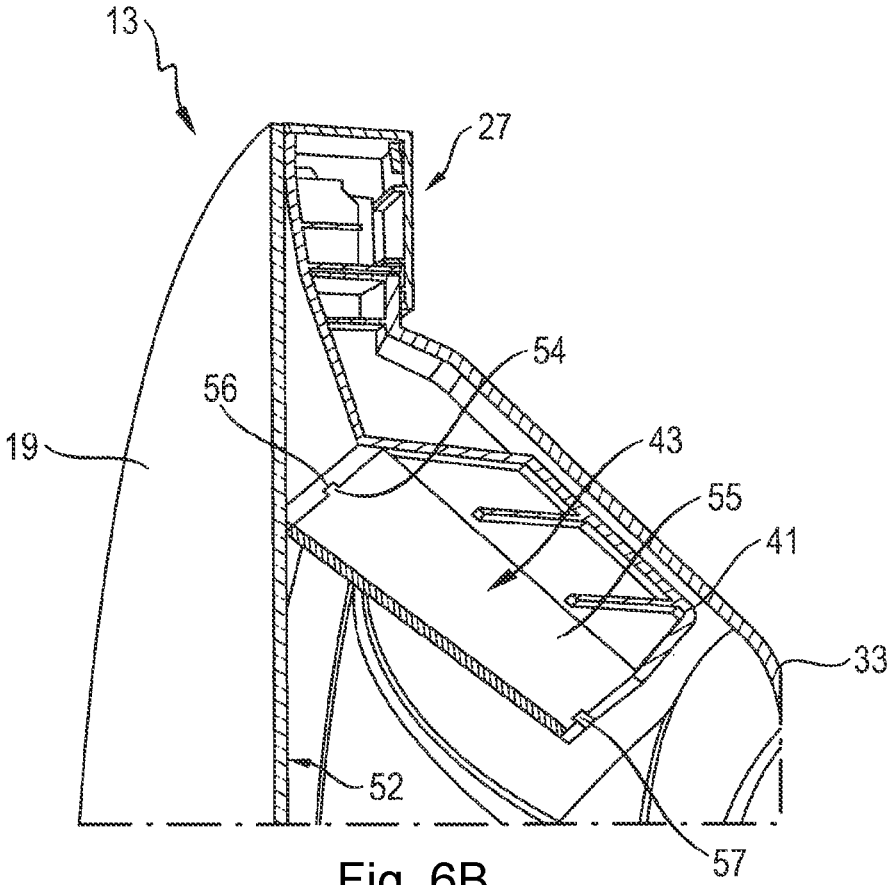
FIG. 6*b* shows an exemplary arrangement of the reflection element.

FIG. 6*b* shows an exemplary arrangement of the reflection element 43. The reflection element 43 is arranged on or in the holding apparatus 41. The holding apparatus 41 has at least one receiving opening 56. The at least one receiving opening 56 is suitable for receiving the at least one first projecting part 54. It is self-evident that the holding apparatus 41 has at least the same number of receiving openings 56 as the reflection element 43 has first projecting parts 54.

Furthermore, the at least one receiving opening 56 is adapted to the at least one projecting part 54 of the reflection element 43 such that, for example, a larger receiving opening 56 corresponds to or is compatible with a larger projecting part 54 in order, as mentioned above, to minimize assembly errors.

The holding apparatus 41 in FIG. 6*b* is preferably embodied in one piece with the at least one frame element 27. However, it is also conceivable that the holding apparatus 41 can be fastened to the at least one frame element 27. For example, the holding apparatus 41 can be welded and/or screwed and/or glued with and/or snapped into the at least one frame element 27. Furthermore, other connection options are conceivable. The holding apparatus 41 is preferably adapted to a contour of the window element 33.

The holding apparatus 41 further comprises at least one second projecting part 57. The at least one second projecting part 57 is preferably embodied on a side opposite the side of the reflection element 43 on which the at least one first projecting part 54 is embodied. The at least one second projecting part 57 is preferably embodied as a type of latching lug. The reflection element 43 is inserted with its at least one first projecting part 54 in the at least one receiving opening 56 of the holding apparatus 41 and clipped or latched into the holding apparatus 41, for example by means of the at least one second projecting part 57 of the holding apparatus 41. The at least one second projecting part 57 is used to retain, hold or fix the reflection element 43 and/or to receive it in a vibration-proof manner on or in the holding apparatus 41. Further fixing elements are conceivable.

Figure 7A:
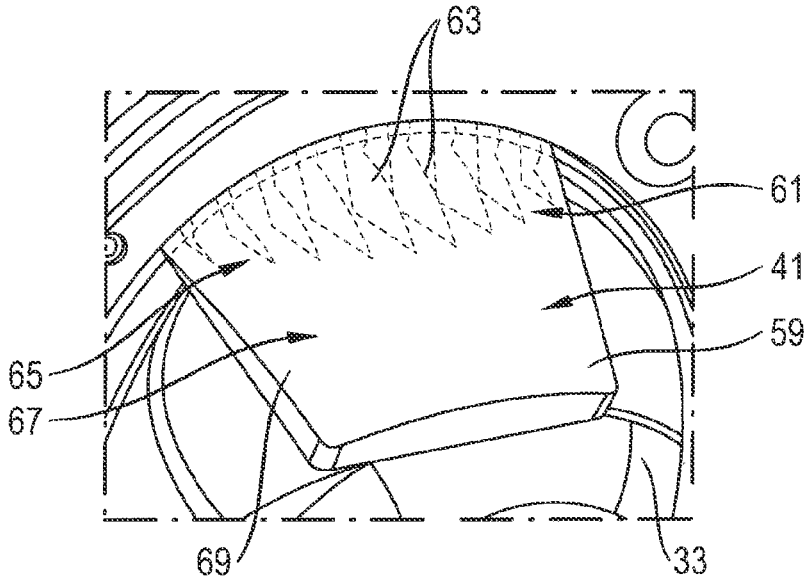
FIG. 7*a* shows a rear side of a holding apparatus.

FIG. 7*a* shows a rear side 59 of a holding apparatus 41. The rear side 59 is arranged in the direction of the window element 33. Furthermore, the rear side 59 of the holding apparatus 41 comprises at least one first region 61. The at least one first region 61 comprises at least one first rib 63. In the exemplary embodiment shown by way of example in FIG. 7*a*, the at least one first region 61 comprises a plurality of first ribs 63. The first ribs 63 are provided to reinforce the holding apparatus 41. The at least one first region 61 of the rear side 59 of the holding apparatus 41 is visible through the window element 33 when the door unit 13 of the fluid-conducting household appliance 1 is open.

The at least one first rib 63 extends at least partially over an upper partial region 65 of the rear side 59. The upper partial region 65 is arranged in the region of the at least one frame element 27 and the window element 33. A cover element 69 is provided in a lower partial region 67 of the rear side 59. The lower partial region 67 adjoins the upper partial region 65 and is substantially arranged in the region of the window element 33.

The at least one first rib 63 and the cover element 69 are visible through the window element 33 when the door unit 13 is open. The cover element 69 is predominantly provided for aesthetic reasons and can, for example, be connected to the holding apparatus 41 via snap-in connections. The shape of the cover element 69 is preferably adapted to the shape of the window element 33 such that no visually unsightly spaces occur between the window element 33 and the holding apparatus 41.

Figure 7B:
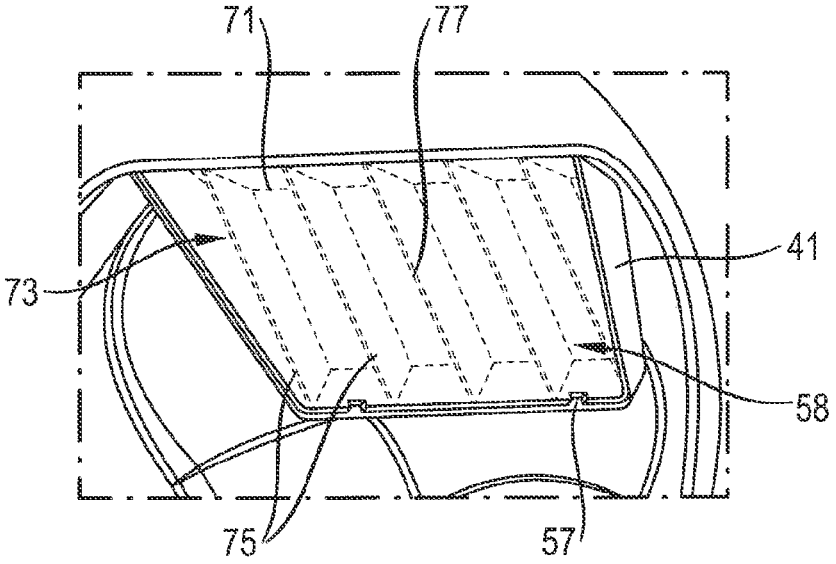
FIG. 7*b* shows an anterior side of a holding apparatus.

FIG. 7*b* shows an anterior side 71 of a holding apparatus 41. The anterior side 71 is embodied opposite the rear side 59 of the holding apparatus 41 such that the anterior side 71 is at least partially spaced further apart from the window element 33 than the rear side 59 of the holding apparatus 41. The anterior side 71 comprises at least one second region 73. The at least one second region 73 comprises at least one second rib 75. In the exemplary embodiment shown by way of example in FIG. 7*b*, the at least one second region 73 comprises a plurality of second ribs 75. The second ribs 75 are provided to reinforce the holding apparatus 41.

The at least one second rib 75 comprises at least one elevation 77. The at least one elevation 77 is preferably embodied in a central region of the at least one second rib 75. In the case of a plurality of second ribs, it is preferably provided that the at least one elevation 77 is embodied in a central region of the plurality of second ribs 75. The at least one second rib 75 is at least partially covered by the reflection element 43. In other words, the reflection element 43 is attached to the holding apparatus 41 with fastening means such that the at least one second rib 75 is covered by the reflection element 43. In the exemplary embodiment in FIG. 7*b*, the at least one rib 75 is depicted visibly. This is only for purposes of better illustration. As mentioned above, the reflection element 43 is embodied as substantially non-transparent.

Figure 8:
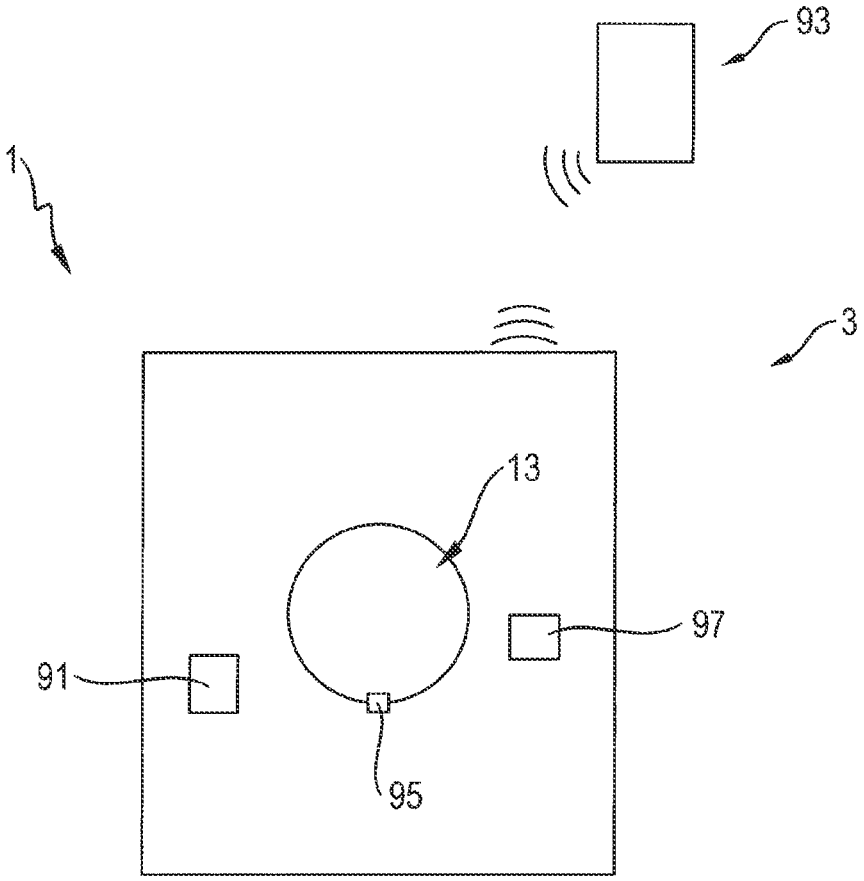
FIG. 8 shows a fluid-conducting household appliance, with an internal appliance and/or an external appliance.

FIG. 8 shows a further exemplary embodiment of a fluid-conducting household appliance 1. In the exemplary embodiment shown in FIG. 8, the fluid-conducting household appliance 1 has an internal appliance 91 and/or an external appliance 93 for communication between an operator or user and a fluid-conducting household appliance 1. The internal appliance 91 and/or external appliance 93 can be a tablet, smartphone or the like. It is important that the internal appliance 91 and/or the external appliance 93 comprises a touch-sensitive surface and/or a touch-sensitive display for displaying and setting operating and/or program parameters.

The fluid-conducting household appliance 1 has a communication unit 95. The communication unit 95 is in connection with the internal appliance 91 and/or the external appliance 93 and communicates with the internal appliance 91 and/or the external appliance 93. The communication unit 95 is configured such that at least projection images 23 can be transmitted to the internal appliance 91 and/or the external appliance 93. As a result, the projection surface 20 of the fluid-conducting household appliance 1 and/or the washing machine 3 can be depicted on the internal appliance 91 and/or the external appliance 93. However, it is also conceivable that the external appliance 93 can be attached to the fluid-conducting household appliance 1 or that an internal appliance 91 is embodied in and/or on the fluid-conducting household appliance 1. The internal appliance 91 can have similar properties to those of the external appliance 93.

Furthermore, the communication unit 95 is configured such that the communication unit 95 receives input commands from the internal appliance 61 and/or external appliance 93 and transmits the input commands to a control apparatus 97. The control apparatus 97 is used to actuate the fluid-conducting household appliance 1, but also to actuate the projection unit 39 and its components. As a result, the operator is able to communicate with the fluid-conducting household appliance 1 and/or the washing machine 3 without entering an input command directly on the fluid-conducting household appliance 1 and/or the washing machine 3.

The external appliance 95 can be a smartphone or a tablet on which the projection images 23 can be depicted in graphical form. It is also conceivable that the fluid-conducting household appliance 1 is operated via the external appliance 93. The internal appliance 91 can be a processor. However, it is also conceivable that the internal appliance 91 is a smartphone or a tablet that is detachably connected to the fluid-conducting household appliance 1 or is permanently connected to the fluid-conducting household appliance 1. Properties of the internal appliance 91 can be identical to properties of the external appliance 93.

The communication unit 95 can, for example, be arranged in the door unit 13 of a fluid-conducting household appliance 1 or of a household appliance 1. However, the communication unit 95 can also be arranged at any other point of attachment in the door unit. Advantageously, the communication unit 95 should be arranged in the region of the projection unit 39. However, it is also conceivable that the communication unit 95 is integrated in the projection unit 39. The communication unit 95 can be connected to the projection unit 39 wirelessly and/or by an electrical connection.

LIST OF REFERENCE NUMBERS

1. Fluid-conducting household appliance
3. Washing machine
5. Housing
6. Receiving container
7. Front side
9. Side walls
11. Opening
13. Door unit
15. Dispensing drawer
17. Switch
19. Viewing window
20. Projection surface
21. Partial region of the viewing window
23. Projection image
27. Frame element
28*a* First frame element
28*b* Second frame element
31. Window ring
32. Handle
33. Window element
35. Cavity
37. Optical unit
38. Light
39. Projection unit
40. Holding unit
41. Holding element
42. Electronic unit
43. Mirror-like element
45. Projector
47. Computer unit
49. Control unit
50. Positioning element
51. Cooling unit
52. Inner side
53. Frame opening
54. First projecting part
55. Coated surface
56. Receiving opening
57. Second projecting part
59. Rear side
61. First region
63. First rib
65. Upper partial region
67. Lower partial region
69. Cover element
71. Anterior side
73. Second region
75. Second rib
77. Elevation
91. Internal appliance
93. External appliance

95. Communication unit

97. Control apparatus

The invention claimed is:

1. A fluid-conducting household appliance, comprising:

a housing having a receiving container and an opening formed therein;

a door unit disposed adjacent to said opening, said door unit having a viewing window and a window element, said window element being embodied opposite said viewing window and at least partially protrudes into said receiving container when said door unit is closed, wherein said viewing window being substantially transparent so that said receiving container can be viewed when said opening is closed;

a projection surface disposed in a region of said viewing window;

an electronic unit having at least one projection unit, wherein said at least one projection unit emitting light such that visual information is visible on said projection surface;

an optical unit having at least one reflection element, wherein said optical unit being disposed in an upper region of said door unit such that the light emitted by said projection unit is reflected by said at least one reflection element of said optical unit onto said projection surface in the region of said viewing window, said optical unit further having a holding apparatus, wherein said at least one reflection element is disposed on said holding apparatus, wherein said holding apparatus has a rear side disposed in a direction of said window element, wherein said rear side has at least one first region containing at least one first rib; and said door unit further having at least one frame element and said at least one reflection element is disposed in said upper region of said door unit in a region of said at least one frame element, said at least one frame element disposed closer to said receiving container than said viewing window when said door unit is closed.

2. The fluid-conducting household appliance according to claim 1, wherein said at least one reflection element has mirror-like properties and is embodied as substantially non-transparent.

3. The fluid-conducting household appliance according to claim 1, wherein said optical unit is connected to said at least one frame element.

4. The fluid-conducting household appliance according to claim 1, wherein said optical unit can be connected to said at least one frame element.

5. The fluid-conducting household appliance according to claim 1, wherein said holding apparatus of said optical unit is embodied in one piece with said at least one frame element.

6. The fluid-conducting household appliance according to claim 1, wherein said holding apparatus has an anterior side embodied opposite said rear side such that said anterior side is at least partially spaced further apart from said window element than said rear side of said holding apparatus, wherein said anterior side has at least one second region containing at least one second rib.

7. The fluid-conducting household appliance according to claim 6, wherein said at least one reflection element is disposed on said anterior side of said holding apparatus and said at least one second rib has an elevation.

8. The fluid-conducting household appliance according to claim 6, wherein said optical unit has at least one fastening means, said at least one reflection element can be attached to said holding apparatus by said at least one fastening means such that said at least one second rib is at least partially covered.

9. The fluid-conducting household appliance according to claim 5, wherein said at least one reflection element has at least one first projecting part and said holding apparatus has at least one first receiving opening formed therein such that said at least one first projecting part of said at least one reflection element can be introduced into said at least one first receiving opening, wherein said holding apparatus has at least one second projecting part that holds said at least one reflection element in position.

10. The fluid-conducting household appliance according to claim 1, wherein said optical unit is disposed on said window element.

11. A door unit of a fluid-conducting household appliance, the fluid-conducting household appliance having a housing with a receiving container and an opening formed therein, the door unit comprising:

a window element being embodied opposite said viewing window and at least partially protrudes into the receiving container when the door unit is closed, wherein said viewing window being substantially transparent so that the receiving container can be viewed when the opening is closed;

a projection surface disposed in a region of said viewing window;

an electronic unit having at least one projection unit, wherein said at least one projection unit emitting light such that visual information is visible on said projection surface;

an optical unit having at least one reflection element, wherein said optical unit being disposed in an upper region of the door unit such that the light emitted by said projection unit is reflected by said at least one reflection element of said optical unit onto said projection surface in the region of said viewing window, said optical unit further having a holding apparatus, wherein said at least one reflection element is disposed on said holding apparatus, wherein said holding apparatus has a rear side disposed in a direction of said window element, wherein said rear side has at least one first region containing at least one first rib; and at least one frame element, said at least one reflection element is disposed in said upper region of said door unit in a region of said at least one frame element, said at least one frame element disposed closer to said receiving container than said viewing window when said door unit is closed.

* * * * *